United States Patent [19]

Zwarts

[11] 4,140,294

[45] Feb. 20, 1979

[54] DRAPERY SUSPENSION BRACKET

[76] Inventor: Andrew R. Zwarts, 276 W. 23rd St., Holland, Mich. 49423

[21] Appl. No.: 804,554

[22] Filed: Jun. 8, 1977

[51] Int. Cl.[2] ..... A47H 1/10

[52] U.S. Cl. ..... 248/265; 248/270; 248/287

[58] Field of Search ..... 248/256–265, 248/269–272, 287, 295, 298

[56] References Cited

U.S. PATENT DOCUMENTS

| | | | |
|---|---|---|---|
| 752,397 | 2/1904 | Jones | 248/271 |
| 1,356,237 | 10/1920 | Szefczyk | 248/271 |
| 1,373,333 | 3/1921 | Kennedy et al. | 248/256 |
| 1,581,313 | 4/1926 | Gannon | 248/258 |
| 2,918,245 | 12/1959 | Cameron | 248/263 |
| 3,199,823 | 8/1965 | Stall | 248/265 |
| 3,241,684 | 3/1966 | Willsey | 248/265 X |
| 3,370,819 | 2/1968 | Kenney | 248/265 |
| 3,430,908 | 3/1969 | Kowalczyk | 248/265 |
| 3,946,978 | 3/1976 | Evans | 248/264 |
| 3,994,463 | 11/1976 | Baker | 248/265 |

FOREIGN PATENT DOCUMENTS

| | | | |
|---|---|---|---|
| 17706 | 10/1898 | Switzerland | 248/265 |

*Primary Examiner*—Lawrence J. Staab
*Attorney, Agent, or Firm*—Glenn B. Morse

[57] ABSTRACT

A bracket for adjustably supporting a drapery suspension rod has a mounting section, and also has a cantilever supporting arm with a base in guideway interengagement with the mounting section to provide vertical adjustability. The cantilever arm has a cross-section providing top and bottom surfaces presenting different but similar, guideway configurations interengagable with particular different standard fittings, respectively, to provide horizontal adjustability. The mounting section has an outwardly offset portion establishing the guideway configuration, which slidably receives securing nuts in non-rotative relationship.

3 Claims, 8 Drawing Figures

FIG. 5
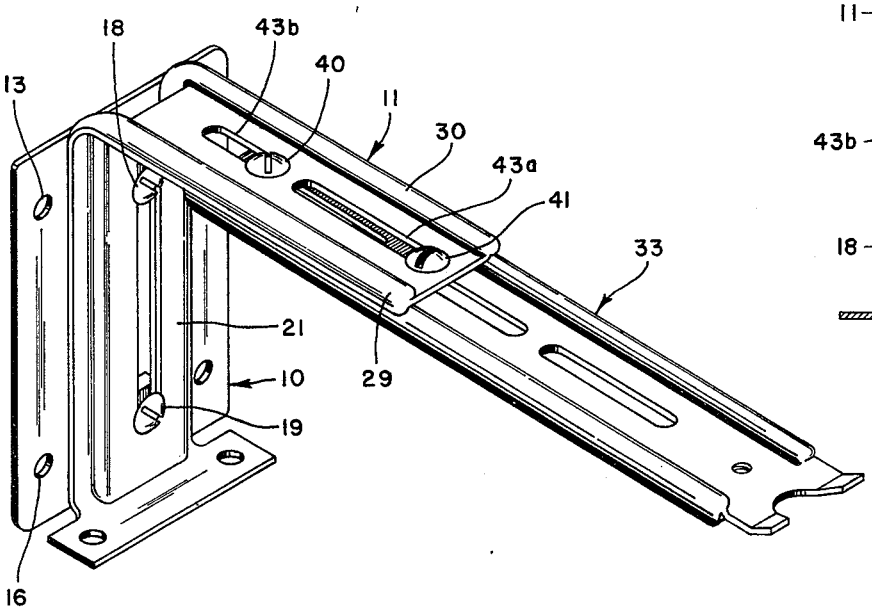
FIG. 4
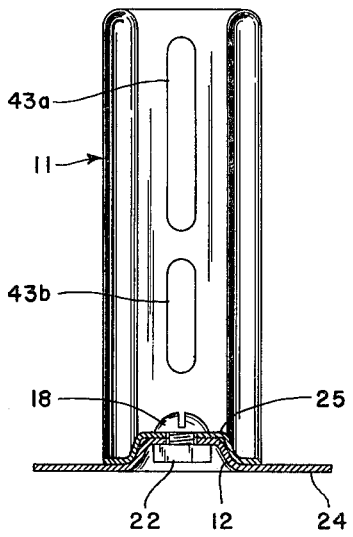
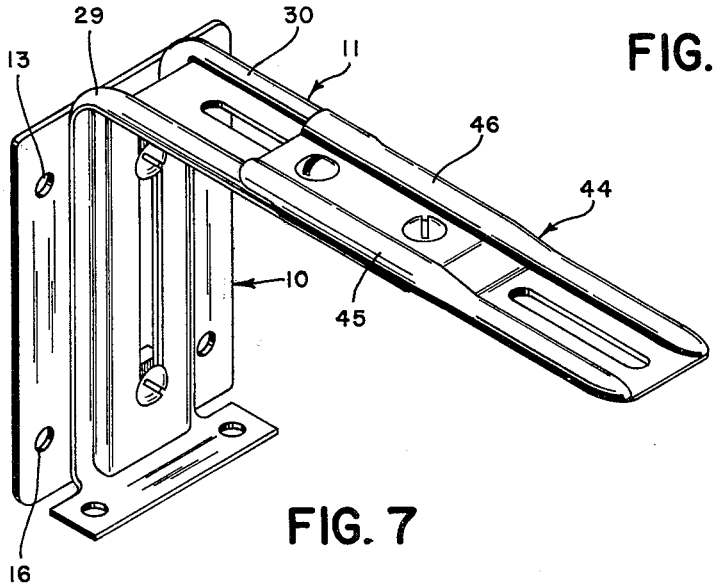
FIG. 6
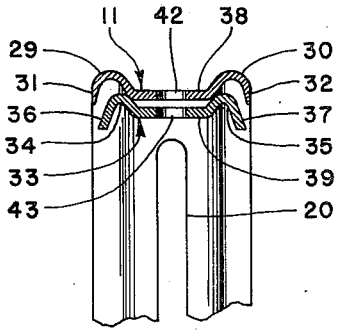
FIG. 7
FIG. 8
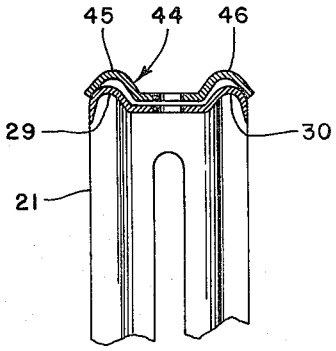

DRAPERY SUSPENSION BRACKET

BACKGROUND OF THE INVENTION

Draperies are normally suspended from rods supported by brackets secured to the wall structure directly above window openings. The usual bracket has a mounting portion provided with holes for receiving screws of sufficient length to traverse the surface material of a wall, and engage the studs or other structural frame members. The usual bracket also includes a cantilever arm extending generally horizontally out from the wall a sufficient distance to provide hanging clearance for the draperies when fully pleated, corresponding to the drawn position. The outer extremity of these arms normally has a hook forming a cradle for receiving a decorative rod carrying a series of rings usually secured to the drape at each pleat. The hook, or rod cradle, maybe provided as a separate item attachable to the cantilever arm, and it is also common practice to provide extensions of the arm to accommodate unusual installation conditions. The presence of a relatively few large-scale manufacturers in this field has resulted in correspondingly few common configurations for these members, and it is obviously very desirable that the bracket structure accommodate these auxiliary fittings that are most frequently encountered.

At least two degrees of adjustability — vertical, and in a direction perpendicular to the wall — are urgently needed in these support brackets, and have not been adequately provided. Installation problems are responsible for some of these needs, as it is obviously necessary to establish a particular position of the drapes with respect to the window opening. Variation in wall structure, including the placement of marginal members surrounding the window opening, results in a variation in the locations where adequate fastenings can be installed with enough security to resist normal and accidental forces. Another factor responsible for the need for vertical adjustability is represented by possible accumulations as of small errors in measurement and manufacture. It must also be kept in mind that the length of the drapes can be expected to vary considerably with changes in the humidity in the room. It may, for this reason, be desirable to shift the point of support of the drapes between winter and summer, which usually represents substantial changes in the humidity due to the operation of heating and air-conditioning systems. The present invention has devised as an inexpensive solution to these problems.

SUMMARY OF THE INVENTION

A suspension bracket embodying the present invention has a mounting portion providing a vertical guideway normally interengaged with a geometrically similar configuration on a base preferably integral with the cantilever supporting arm. Securing means traversing both of these members are adapted to lock the vertical position of the supporting arm with respect to the mounting portion of the assembly. An offset providing the guideway on the mounting portion serves the additional function of receiving preferably square nuts of the screw-nut assemblies securing the adjusted vertical relationship. These nuts are preferably slidably received in nonrotative relationship by the configuration of the offset. The cantilever supporting arm provides a cross-sectional configuration forming a horizontal guideway interengageable with the standard end-fittings commonly available, including rod cradles and extensions. This arm cross-section results from offsets forming ridges and grooves in a direction perpendicular to the mounting surface, and these offsets are preferably die-formed in sheet steel. It has been found possible to provide a configuration which will interengage with the adjacent portions of the standard cradle and extension fittings, which differ from each other dimensionally, but are geometrically similar. The principal two of these cross-sectional configurations are accommodated by the present invention by the installation of one of them on the top of the horizontal arm, and the other on the underside. Appropriate securing devices, such as screw-nut assemblies, traverse the adjacent sections of the fittings and the horizontal arm at points which are normally spaced slightly from each other when the guideway components are in firm contact. Tightening of these fastenings therefor establishes a resilient pressure causing the interengaged guideway configurations to bear solidly against each other to maintain the proper alignment of the components.

DESCRIPTION OF THE DRAWINGS

FIG. 4 is a sectional view on the plane 4—4 of FIG. 3.

FIG. 5 is a perspective view of the bracket in the FIG. 1 position, with a standard arm extension secured in position.

FIG. 6 is a section through the arm and extension shown in FIG. 5.

FIG. 7 is a view similar to FIG. 5, but showing another type os standard arm extension secured to the bracket assembly.

FIG. 8 is a section through the arm and extension appearing in FIG. 7.

DESCRIPTION OF THE PREFERRED EMBODIMENT

Figure 1:
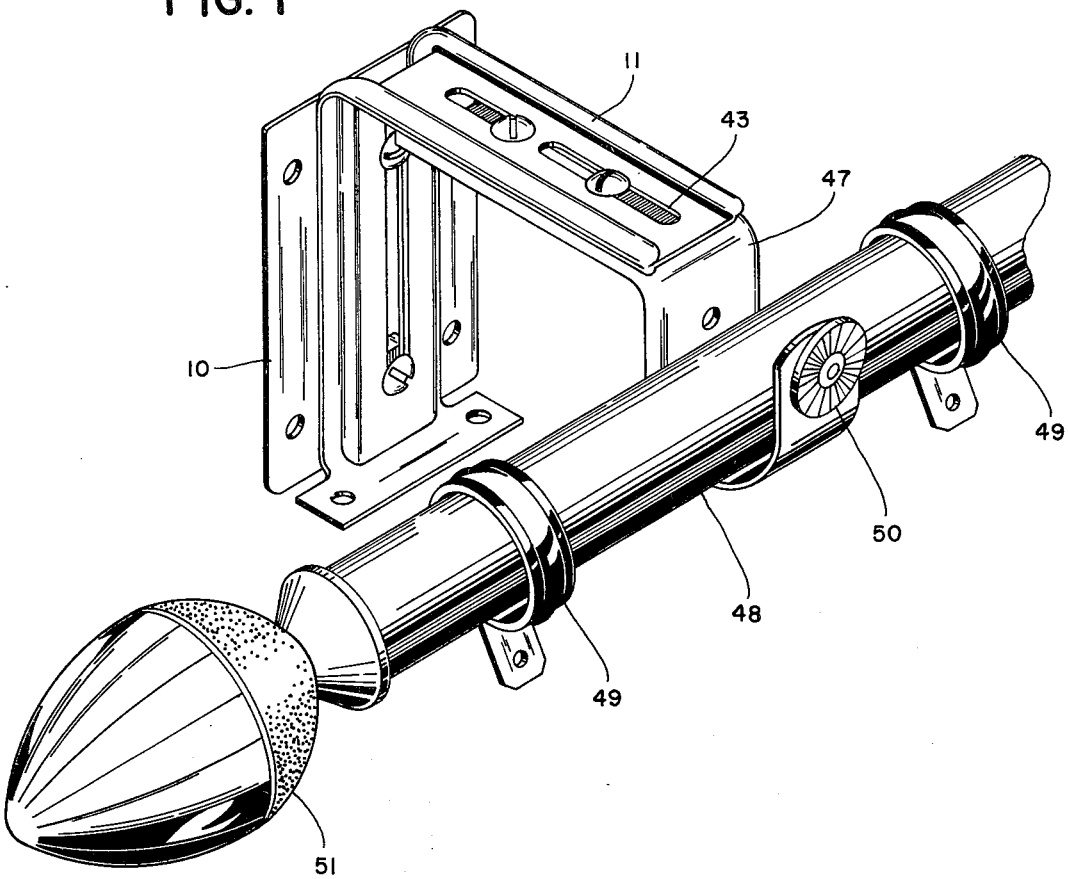
FIG. 1 is a perspective view showing a drapery bracket embodying the present invention, and showing a portion of a conventional drapery rod in supported position.

Referring to the drawings, the illustrated bracket assembly includes the mounting portion generally indicated at 10 and the cantilever arm section 11. The mounting portion is essentially flat plate with an outward offset 12, as best shown in FIG. 4. A set of holes 13–16 is provided to receive wood screws which will normally engage with the heavier members of the wall structure adjacent the top of a window opening.

Figure 3:
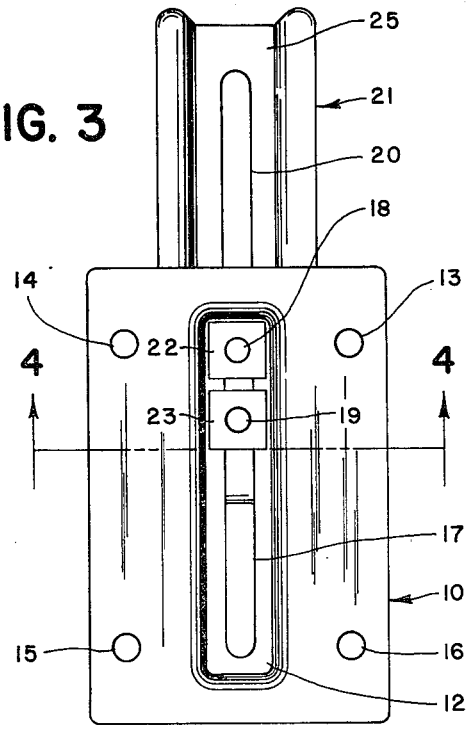
FIG. 3 is a rear view of the bracket assembly at the opposite extreme of adjustability from the FIG. 2 position.
Figure 2:
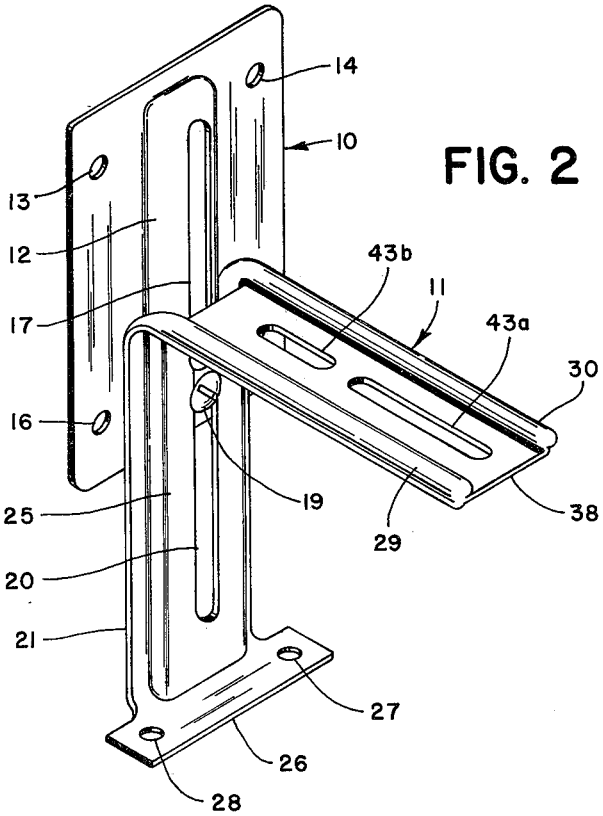
FIG. 2 is a perspective view of the mounting bracket alone, showing one extreme of the range of vertical adjustability.

A slot 17 in the offset portion 12 receives the screws 18 and 19, which also traverse the slot 20 in a base section indicated at 21 integral with the arm 11. The nuts 22 and 23 (refer to FIG. 3) associated respectively with the screws 18 and 19 are received within the offset 12 in slideable, but non-rotative relationship, so that the tightening of the screws 18 and 19 can be accomplished easily without access to the back of the assembly. As shown in FIG. 4, the screws and the associated nuts are received within the offset to the point that they do not intersect the plane of the mounting surface 24. The base section 21 of the arm 11 has an offset 25 forming part of the vertical guideway interengagement. The offsets 25 and 12 are in closely-embracing relationship, as shown in FIG. 4, and the tightening of the screws 18 and 19 securely establishes the vertical alignment of the two components. The horizontal flange 26 at the lower extremity of the base 21, and the fastening holes 27 and 28, are provided for situations where it is desirable to secure the position of the arm 11 with respect to a vertical surface associated with the wall structure, with the vertical adjustability previously described premitting vertical placement of the mounting section as may be desired for installation of fastenings to secure the assembly against a tendency to rotate away from the wall under the applied loads.

The cantilever arm 11 is provided with parallel offsets at the respective opposite edges, as shown at 29 and 30. These offsets, and the resulting marginal flanges 31 and 32, form two guideway configurations — one on top of the arm, and one on the bottom. The underside of the arm 11 is used as shown in FIGS. 5 and 6, where the extension 33 has a cross-section generally similar in configuration to that of the arm 11, but dimensionally slightly different. The offsets 34 and 35 provide the marginal flanges 36 and 37, and the upper surfaces of the offsets 34 and 35 interengage with the underside of the offsets 29 and 30 to establish the necessary alignment. The interengagement of the offsets 34 and 35 with the opposite surfaces of the offsets 29 and 30 takes place with the central portions 38 and 39 in spaced relationship. The tightening of the screws 40 and 41 will therefore resiliently urge these interengaged surfaces together to maintain an accurate alignment. The provision of slots as shown at 42 and 43 in these members for the reception of the screws 40 and 41 provides the horizontal adjustability of the assembly. The screws 40 and 41 will normally receive nuts, which are accessible on the underside for providing resistance to rotation while tightening the screws.

The top surface of the cantilever arm 11 is utilized as a guideway as shown in FIGS. 7 and 8. The extension 44 has the offsets 45 and 46, which embrace the offsets 29 and 30, respectively, to maintain the necessary alignment. As shown in FIG. 8, the central portions of these members are in spaced relationship to provide the same resilient clamping action described in connection with FIG. 5.

The extensions 33 and 44, as well as the arm 11 itself, are adapted to receive the hook-shaped member 47 forming a cradle for the decorative rod 48 carrying a group of drapery rings 49. The decorative clamping screw 50 functions to grip the rod 48 and hold it in engagement with the supporting structure. The cross-section of the horizontal portion of the member 47 has the same general configuration as that of the extension 33, and is received on the arm 11 in the manner shown in FIG. 6. The knob 51 is merely provided for decorative purposes as an insert in the end of the tubular rod 48.

I claim:

1. An adjustable drapery-supporting bracket having a mounting portion providing a mounting surface, and also having a cantilever supporting arm, wherein the improvement comprises:

a plate having holes for receiving fastenings and constituting said mounting portion, and having a normally vertical guideway;

a base portion fixed with respect to said cantilever arm, and normally interengaged with said guideway, said base portion additionally having a bottom flange extending normally horizontally from said mounting surface; and securing means normally maintaining an adjusted position of said base portion along said guideway.

2. An adjustable drapery-supporting bracket having a mounting portion providing a mounting surface, and also having a cantilever supporting arm, wherein the improvement comprises:

a plate having holes for receiving fastenings and constituting said mounting portion, and having an elongated, centrally located offset portion providing a normally vertical guideway;

a base portion fixed with respect to said cantilever arm, and normally interengaged with said guideway, said cantilever supporting arm including a receptacle portion secured to said arm for adjustment axially with respect thereto for establishing the distance from said receptacle to said mounting surface, said receptacle portion including a member in overlapping engagement with said arm, said arm and receptacle member having interengaged cross-sections establishing axial parallelism, said arm and said base portion each having a cross-sectional configuration including a central portion extending the length thereof and of complimentary configuration to said offset portion of said plate and lateral portions also extending the length thereof and offset from said central portion, said cross-sectional configuration being continuous across the juncture of said base portion and said arm; and securing means normally maintaining an adjusted position of said base portion along said guideway.

3. A bracket as defined in claim 2, wherein said arm cross-section is established by a pattern of parallel offsets providing axially accessible guideways along the top and bottom thereof.

* * * * *